US006012682A

United States Patent [19]

Tredennick

[11] Patent Number: 6,012,682

[45] Date of Patent: Jan. 11, 2000

[54] GUTTER CLIP

[76] Inventor: John Thomas Tredennick, P.O. Box 275, Pelican Rapids, Minn. 56572

[21] Appl. No.: 09/111,645

[22] Filed: Jul. 8, 1998

[51] Int. Cl.[7] ..... E04D 13/064

[52] U.S. Cl. ..... 248/48.1

[58] Field of Search ..... 248/49, 76, 80; 52/16

[56] References Cited

U.S. PATENT DOCUMENTS

| | | | |
|---|---|---|---|
| 3,572,622 | 3/1971 | Smith | 248/49 |
| 3,819,137 | 6/1974 | Smith | 248/49 |
| 4,169,571 | 10/1979 | Duggan | 248/49 |
| 4,270,572 | 6/1981 | Jarzynka | 137/615 |
| 4,715,570 | 12/1987 | Mashuda | 248/49 |
| 5,522,427 | 6/1996 | Johnson | 137/616.5 |

*Primary Examiner*—Derek J. Berger
*Assistant Examiner*—David Heisey

[57] ABSTRACT

A pair of "L" shaped flat straps connected at one end to form a foot (10) and open at the opposite end to create a clip (21) which, when installed on a rain gutter (16), end piece (18) serves as a leg (20) in the in-use position and swivels and serves as a retaining clip (21) when the end piece (18) is folded up to the storage position.

1 Claim, 7 Drawing Sheets

Gutter Clip with end pipe in up position

GUTTER CLIP

BACKGROUND

1. Field of Invention

This invention relates to eaves trough gutter systems on all roofed structures and specifically relates to attending hardware of a water conducive gutter system.

2. Description of Prior Art

In the past, people have dealt with an end piece of a gutter system in various ways:

1) simply let the end piece be permanently affixed to a downspout;
2) have the end piece removable for lawn maintenance and winter storage;
3) hinge the end piece to swing away during non-usage time; or
4) no end piece at all.

A gutter clip has been contrived to work with a hinged end piece but will enhance any application.

There are straps, wires, and strings to hold end pieces in a raised position but none is particularly appealing.

There are legs, "T's" and blocks used to elevate the working end piece above the grass or other obstructions. These items all need to be moved independently of the end piece for maintenance or storage.

OBJECTS AND ADVANTAGES

Several objects and advantages of the gutter clip are:

(a) To provide a dual purpose (upright retention during storage along with a leg support during use) for enhancing the performance of the end piece.
(b) Can be made to various specifications including size, color, material, and shape;
(c) Can be installed without tools or modifications;
(d) Is easily adjustable;
(e) Is easily understood, no plumbing, no wiring;
(f) Is inexpensive;
(g) Is attractive; and
(h) Helps prevent clogging.

DRAWING FIGURES

REFERENCES NUMERALS IN DRAWINGS

Figure 1:
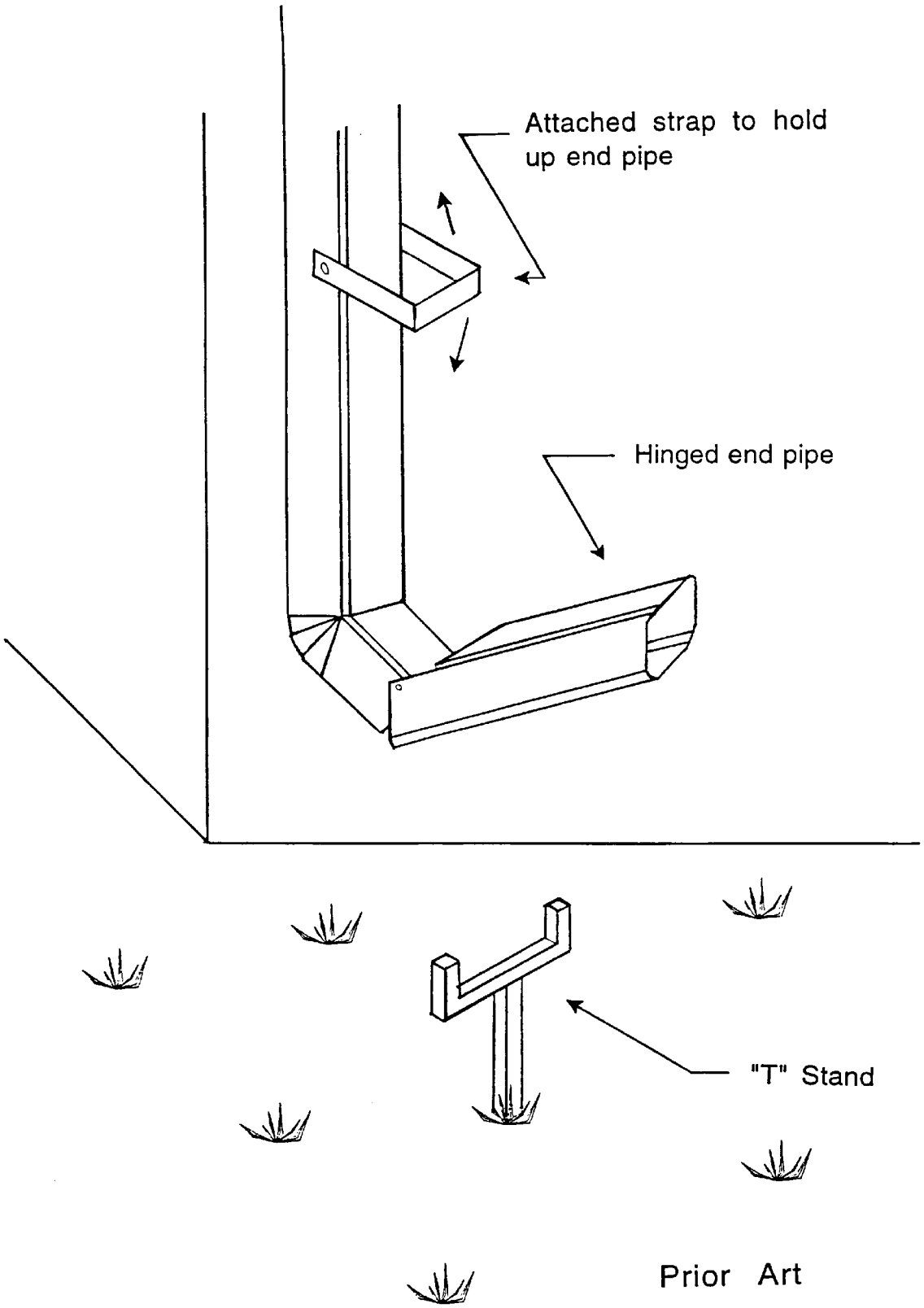
Prior Art FIG. 1
FIG. 1 shows present available systems used with hinged end pieces.

10 foot
11 arm
12 protuberance
13 hinged hole
14 hinging peg
15 cross member
16 gutter

17 downspout
18 end piece
19 hoop
20 arm/leg
21 gutter clip

SUMMARY

In accordance with the previous information, the gutter clip is a self inclusive support leg and retaining clip for a gutter system end piece. The gutter clip can be made of appropriate material, color, size, and shape. The gutter clip enhances the total workings of any gutter system.

DESCRIPTION

Figure 6:
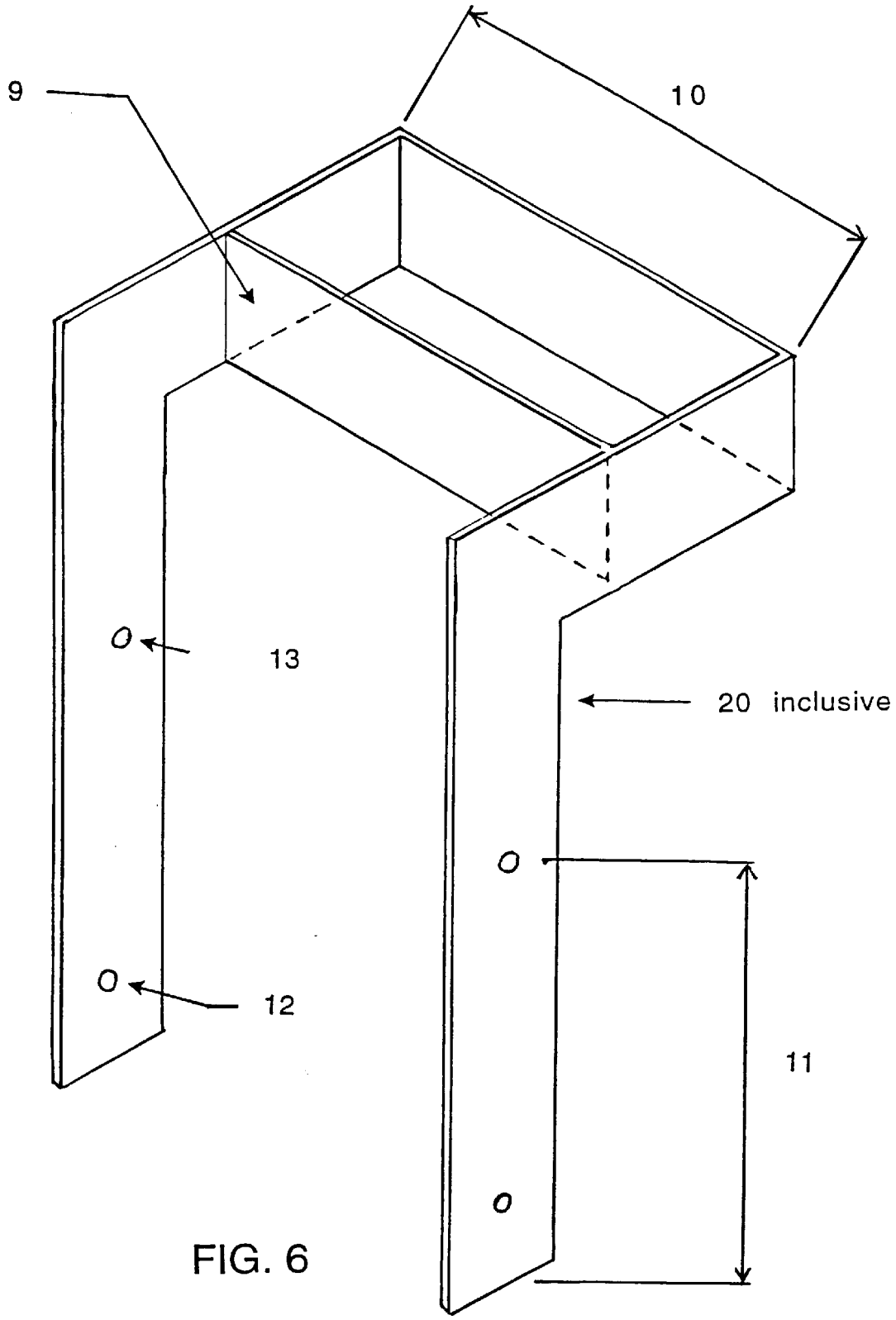
FIG. 6 shows an arm/leg component of the gutter clip.
Figure 7:
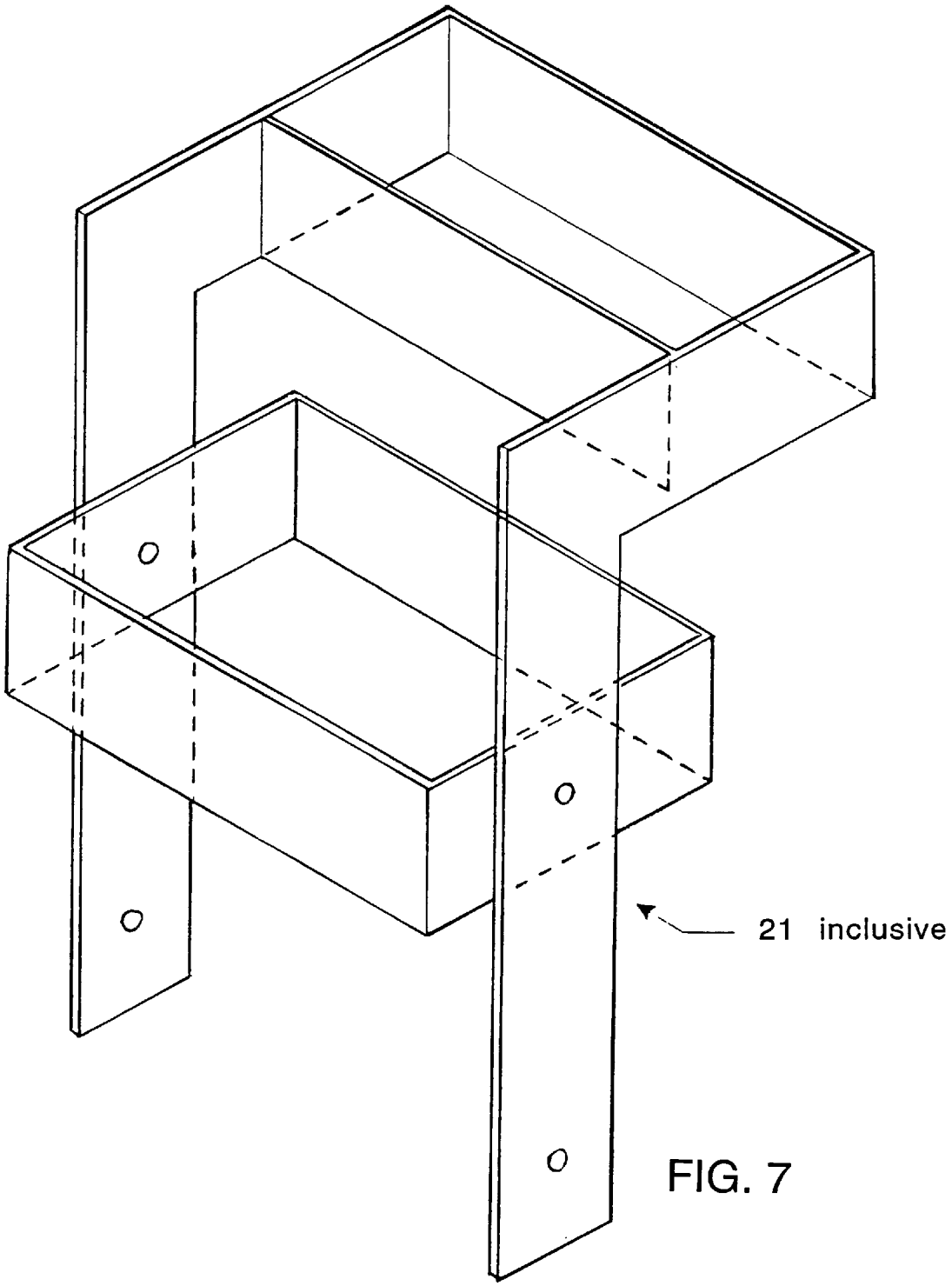
FIG. 7 shows the gutter clip alone.

A typical embodiment of the gutter clip 21 shown in FIG. 6 is illustrated in FIG. 7. The structure can be made of either plastic or metal. Thickness and width of the frame may vary with the strength of the material used in construction. Color is also a variable.

Figure 2:
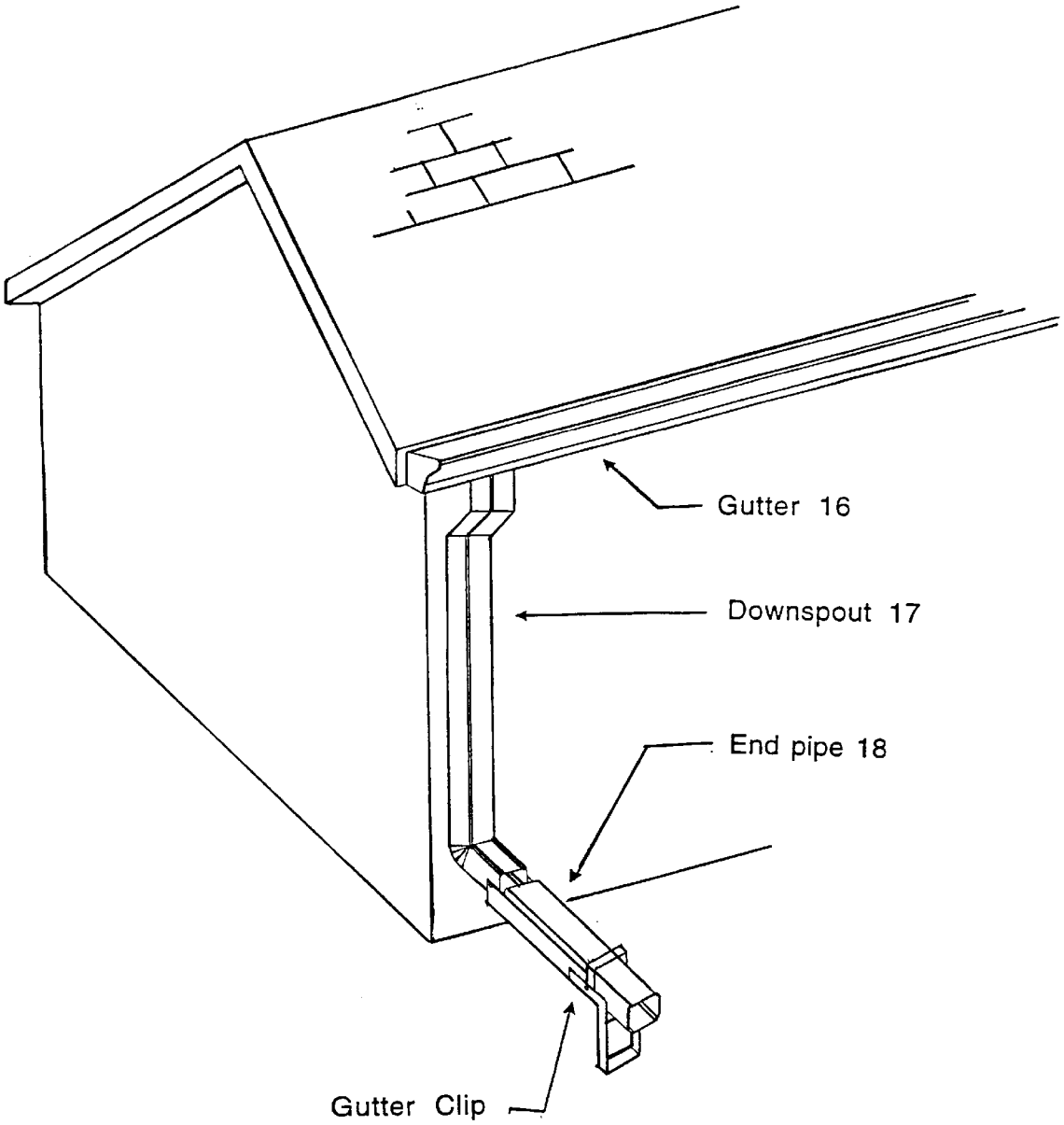
FIG. 2 shows gutter clip in relation to entire gutter system.

The physical size of the gutter clip 21 may also vary and is only limited by the size of the end piece 18 of FIG. 2 to be accommodated.

A foot 10 of the gutter clip 21 as shown in FIG. 6 needs to be tall enough to keep debris from damming the end of the end piece 18. The foot 10 also should be broad enough so as not to sink into the lawn or earth under the end piece 18.

Figure 3:
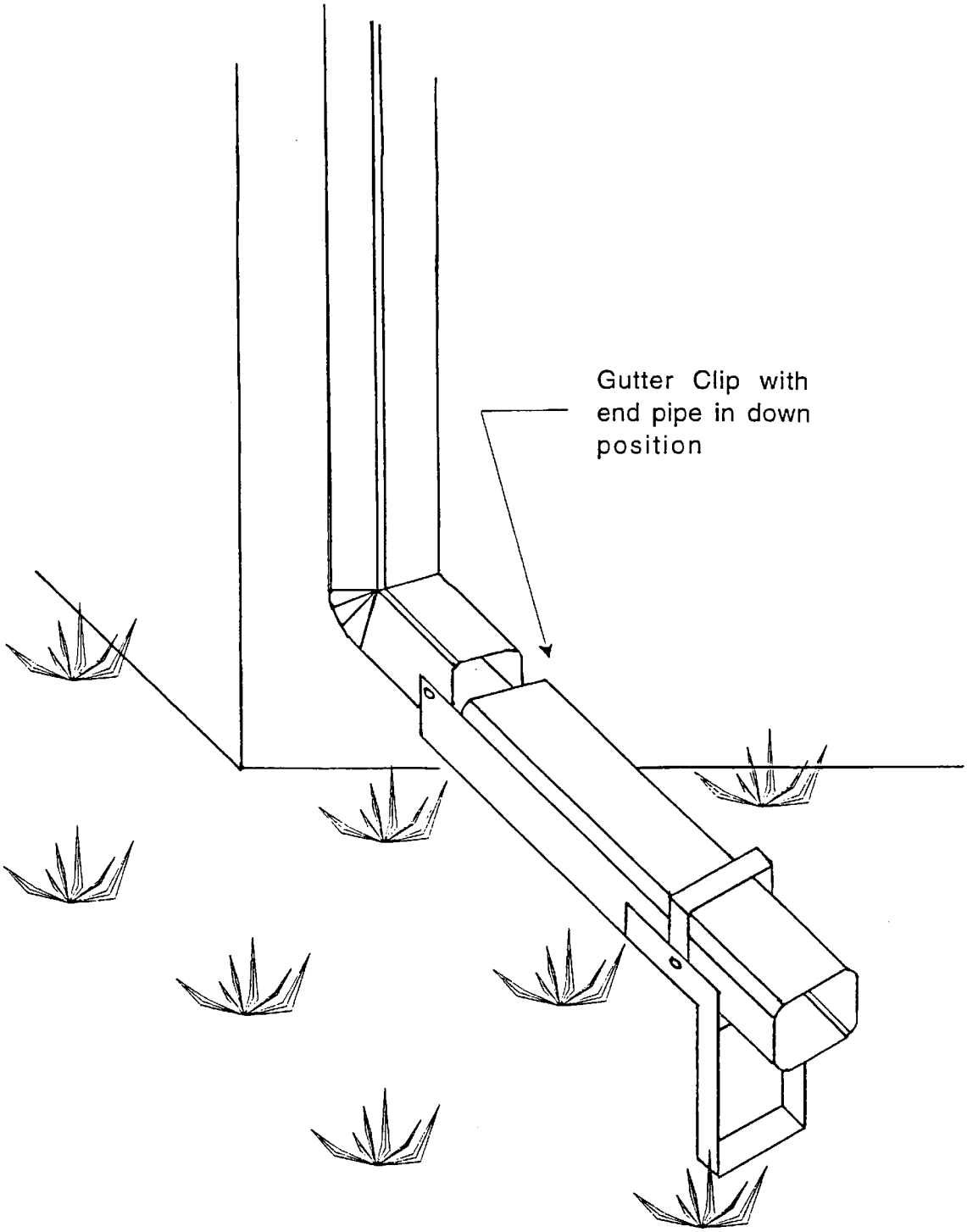
FIG. 3 shows gutter clip employed as a support leg while the end piece is in use.
Figure 4:
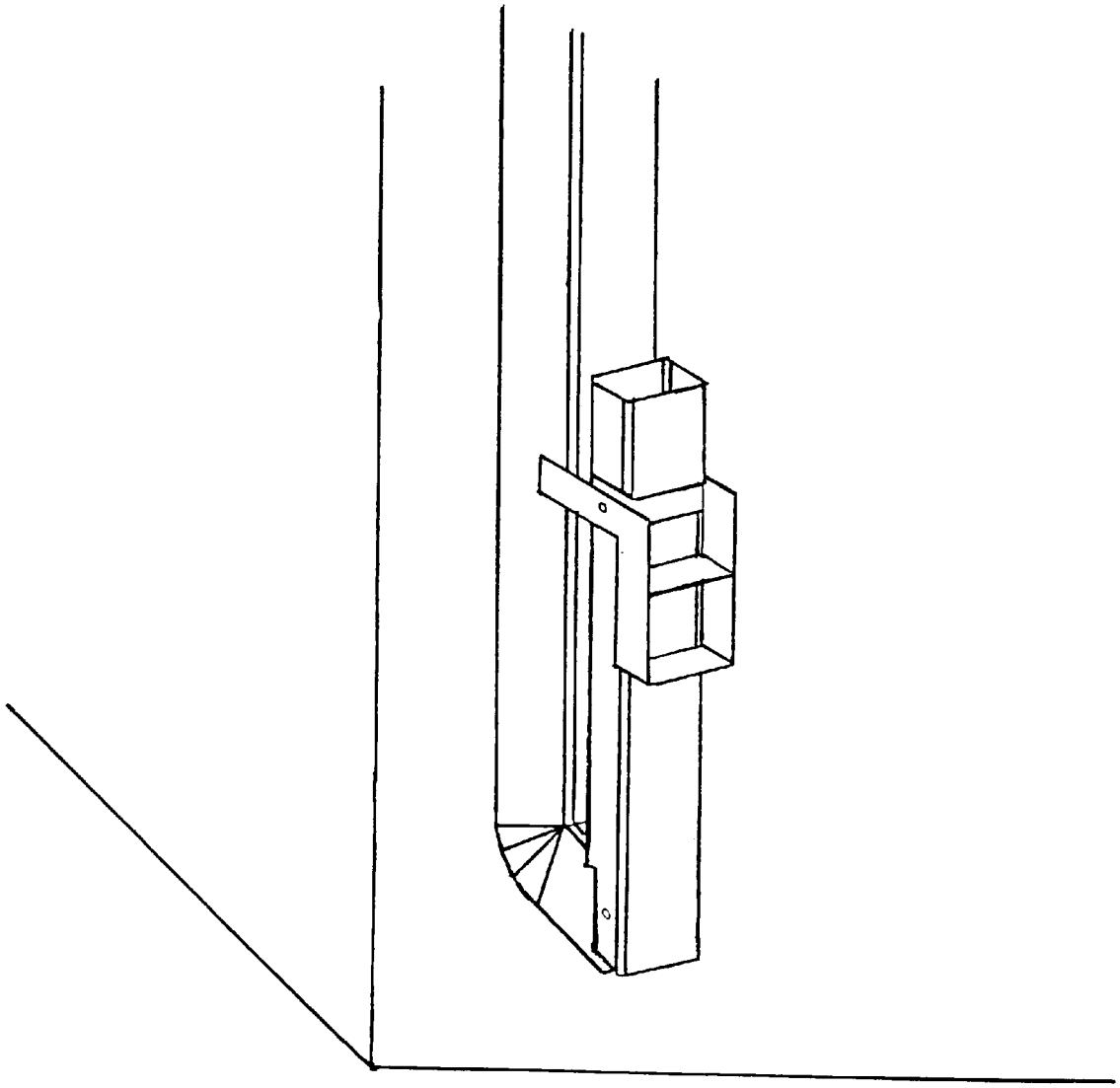
FIG. 4 shows gutter clip retaining the end piece in an upright position when not in use.

Toward the end of each arm 11 shown in FIG. 6 is a protuberance 12 whose purpose is to grip a downspout 17 of FIG. 2 as in FIG. 4 or to grip the end piece 10 as in FIG. 3.

Also on the arm 11 of FIG. 6 is a hole 13 toward the center point. The hole 13 is to engage a peg 14 of FIG. 5. The peg holds the respective parts of the gutter clip 21 FIGS. 5 and 6 together and facilitates a counter revolution of the adjoining parts.

Above the foot 10 of FIG. 6 is a cross member 15. A cross member 15 gives the gutter clip 21 strength and also provides a stop to prevent excessive rotation when in use.

Operation—FIGS. 3, 4

Figure 5:
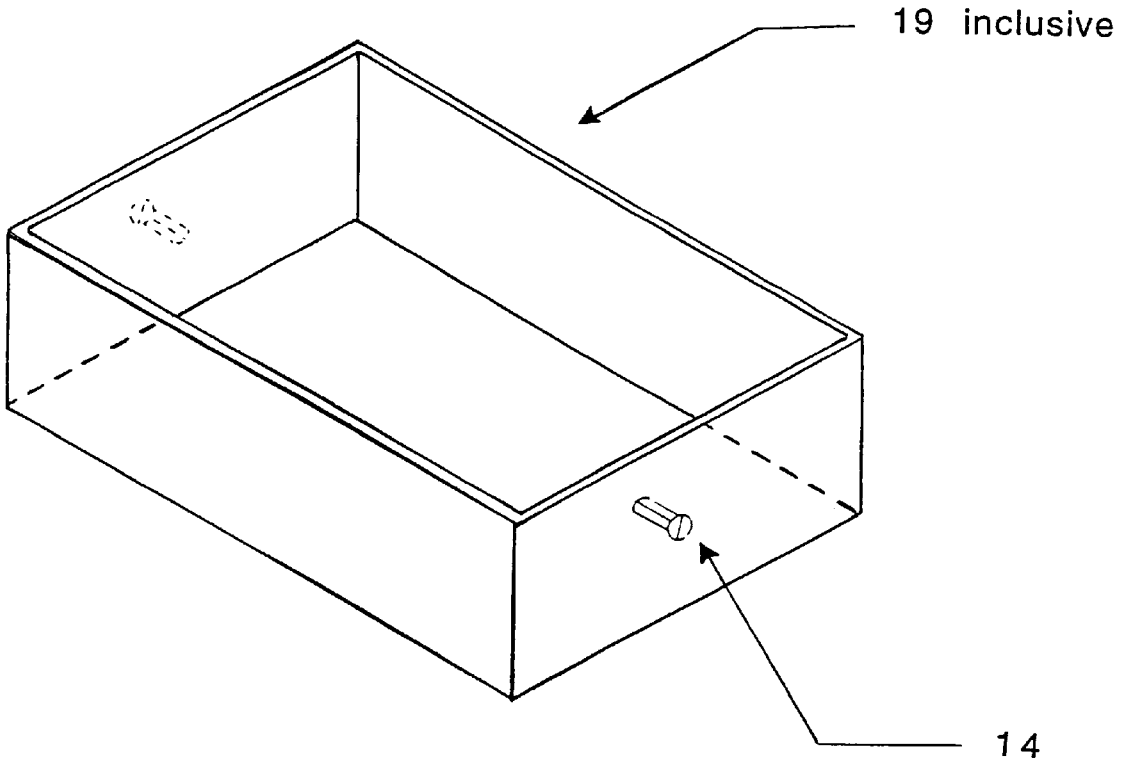
FIG. 5 shows a hoop component of the gutter clip.

A hoop 19 of FIG. 5 slides over the end piece 18 of FIG. 2 with only enough friction to maintain a constant but adjustable position for the gutter clip 21.

The arm/leg 20 portion shown in FIG. 6 rotates 90 degrees on the hoop 19 of FIG. 5. When the end piece 18 is in a working position, the arms 11 are rotated perpendicular to the hoop 19 and the arms 11 grip the tail piece 18 to keep it in position. When the tail piece 18 of the gutter system FIG. 1 is not in use or is elevated to facilitate maintenance, the arms 11 of the gutter clip 21 rotate parallel to the hoop 19 and grasp the downspout 17.

The entire gutter clip 21 will easily slide along the length of the end piece 18 to either accommodate a change in elevation of the discharge end of the end piece 18 or to improve ease of accessibility.

Conclusion, Ramifications, and Scope

The concept of the gutter clip is an "L" shaped swiveling bracket device that acts both as a supportive leg and a clip in relation to the end piece of a gutter system. The leg holds the end piece a few inches off the ground so that water can pass from the end piece without being clogged by twigs, leaves, and other debris that have collected at the opening of the piece. The gutter clip can be used also to hold the end piece in an upright position against the downspout when not in use.

The gutter clip accessory measures approximately 6 inches long, 3 inches wide, and 6 inches high. It can be made of any appropriate material and can be of any color. This accommodation of material and color is a convenience to the manufacturer and to the ultimate user of the gutter clip.

The gutter clip allows for easy installation and adjustments. The elevation of the end piece can be adjusted by sliding the device along the length of the end piece.

The gutter clip serves a dual purpose as a leg that does not remain behind when the end piece is elevated, and also provides a clip to hold the end piece in the raised position. Again, when the end piece is lowered to the lawn, no straps or wires remain on the downspout.

The gutter clip can be used as a leg support even if the end piece were not hinged to fold.

The ability to fold the end piece into an upright position is a great convenience when mowing or entertaining. The gutter clip makes that convenience more practical.

Although the description above contains many specifics, these should not be construed as limiting the scope of the invention but as merely providing illustrations of some of the presently preferred embodiments of this invention. For example, the gutter clip can have other shapes with smoother edges and more rounded corners. The hinges and protuberance can be accommodated in some other fashion.

Thus the scope of the invention should be determined by the appended claims and their legal equivalents, rather than by the examples given.

What is claimed is:

1. The gutter clip is a device of dual function used to assist standard gutter fixtures of fixed dimensions to support an eaves trough downspout end piece during use and to hold said end piece in a storage position during non-use comprising a rectangular frame measuring about two and one-half inches on the short side by about three and one-half inches on the long side with two arms about seven inches long having perpendicular leg continuations of said arms of approximately nine inches affixed parallel and center to each of the short sides of said rectangle at approximately one-third the distance from said leg continuation of said arm in such a fashion as to permit rotation of said arm also said legs are held parallel to each other by a cross piece at the ends of said legs and another cross piece two-thirds up the length of said legs.

* * * * *